US005934976A

United States Patent [19]

Makino et al.

[11] Patent Number: 5,934,976

[45] Date of Patent: Aug. 10, 1999

[54] METHOD FOR GRINDING A TAPER SURFACE AND GRINDING APPARATUS USING THE SAME

[75] Inventors: Atsushi Makino, Anjo; Naruhito Ishikawa, Okazaki, both of Japan

[73] Assignee: Denso Corporation, Kariya, Japan

[21] Appl. No.: 08/854,541

[22] Filed: May 12, 1997

[30] Foreign Application Priority Data

May 15, 1996 [JP] Japan ..... 8-120303

[51] Int. Cl.[6] ..... B24B 5/00

[52] U.S. Cl. ..... 451/28; 451/49; 451/51; 451/165; 451/115; 451/252; 451/430

[58] Field of Search ..... 451/49, 51, 28, 451/165, 910, 115, 252, 27, 189, 430, 180, 120, 124

[56] References Cited

U.S. PATENT DOCUMENTS

| | | | |
|---|---|---|---|
| 3,897,659 | 8/1975 | Henry | 451/910 |
| 4,637,762 | 1/1987 | Acker | 451/430 |
| 4,715,149 | 12/1987 | Kelsey | 451/430 |
| 5,022,195 | 6/1991 | Cattelain et al. | 451/51 |
| 5,101,599 | 4/1992 | Takabayasi et al. | 451/910 |
| 5,133,154 | 7/1992 | Kallenberg | 451/252 |
| 5,303,509 | 4/1994 | Schweizer et al. . | |
| 5,305,556 | 4/1994 | Kopp et al. | 451/124 |
| 5,315,792 | 5/1994 | Schweizer et al. . | |
| 5,361,543 | 11/1994 | Bory | 451/165 |
| 5,655,956 | 8/1997 | Ferreira et al. | 451/156 |

FOREIGN PATENT DOCUMENTS

| | | | |
|---|---|---|---|
| A-59-182055 | 3/1983 | Japan . | |
| A-60-242956 | 5/1984 | Japan . | |
| A-3-73258 | 8/1989 | Japan . | |
| 916267 | 3/1982 | Russian Federation | 451/165 |

*Primary Examiner*—Robert A. Rose
*Assistant Examiner*—George Nguyen
*Attorney, Agent, or Firm*—Nixon & Vanderhye P.C.

[57] ABSTRACT

A lower side of a rotatable grindstone spindle is connected directly to a PZT (Piezoelectric element). By changing electric drive supplied to the PZT, reciprocating movement can be applied to the grindstone through the grindstone spindle in addition to rotational movement. As a result, the grinding locus of an abrasive grain of the grindstone on a taper surface of a workpiece becomes a sine wave, and therefore, the grinding locus can be shifted in a direction other than in a peripheral direction. In this way, the removed amount of the taper surface increases, and circularity of the taper surface can be made to equal to 0.3 $\mu$m or less.

24 Claims, 8 Drawing Sheets

METHOD FOR GRINDING A TAPER SURFACE AND GRINDING APPARATUS USING THE SAME

CROSS REFERENCE TO THE RELATED APPLICATION

This application is based on and claims priority of Japanese Patent Application No. Hei. 8-120303 filed on May 15, 1996, the content of which are incorporated herein by reference.

BACKGROUND OF THE INVENTION

1. Field of the Invention

The present invention relates to a grinding method for grinding a taper surface of parts or products and a grinding apparatus, and especially relates to a grinding method and a grinding apparatus suitable for mass-production.

2. Description of Related Art

Conventionally, methods for grinding a taper contact surface at a top end of a needle valve or a taper valve seat of a valve body, with which the contact surface makes contact, of a fuel injection valve for an internal combustion engine (hereinafter referred to as "engine") have been known, as disclosed in JP-A-60-242956, JP-A-3-3769 and JP-A-3-73258.

In the method disclosed in JP-A-60-242956, a lapping material is interposed between the seat surface and the contact surface, and the needle valve and the valve body are simultaneously ground by rubbing both. In the method disclosed in JP-A-3-3769, an abrasive material is interposed between a contact surface of a needle valve and a seat surface of a valve body, the needle valve and the valve body are rubbed while high-frequency vibration are applied thereto so that the contact surface of the needle valve and the seat surface of the valve body are ground.

In the grinding methods disclosed in JP-A-60-242956 and JP-A-3-3769, because the contact surface of the needle valve and the seat surface of the valve body are ground while each entire periphery thereof is bound, convex portions at each side are worn without being greatly affected by a vibration from an outside thereof. Therefore, circularity is improved, and sealing performance between the needle valve and the valve body improves. However, by grinding both with same taper angle, since contacting performance between the contact surface of the needle valve and the seat surface of the valve body improves excessively, there is a problem in that when the needle valve is opened to be separated from the valve seat timing is delayed or a groove in a peripheral direction is formed at a rubbed portion between the needle valve and the valve body to cause an abnormal shape of the atomized fuel.

To overcome such a problem, it is necessary to grind the needle valve and the valve body with grindstones having different angles, respectively. In the grinding method disclosed in 3-73258, to improve the circularity, there is employed a pressing and contacting type grinding method in which entire peripheral surfaces of a needle valve and a valve body are ground while being bound in contact with grindstones each having a concave-like or convex-like conical taper surface.

However, according to the grinding method disclosed in JP-3-73258, since each of the taper surfaces of the needle valve and the valve body needs to be ground while being in contact with grinding surface of the grinding stone, it is impossible to apply a reciprocating movement to the grindstone. Accordingly, grinding amount of the taper surface by means of the grindstone is extremely small; and therefore, there occurs a problem in that it is difficult to employ a pressing and contacting type grinding method as a finish-grinding process after performing a rough-grinding process, to improve the circularity. Further, to secure a desired circularity, since it is necessary to perform several tens of pressing and contacting type grinding processes; and therefore, there occurs a problem in that grinding time is prolonged and the manufacturing cost rises.

Next, grinding accuracy required for a grinding method of grinding a needle valve and a valve body separately will be described.

In view of the high consciousness for earth environmental protection, a required value of an amount of HC (Hydrocarbon emission) exhausted from a vehicle is strictly regulated year by year. The amount of HC contained in an exhaust gas increases by fuel leaked from a fuel injection valve into an engine; and therefore, it is required to reduce an amount of fuel leaked from the fuel injection valve. According to the U.S. emission regulation, since the required value of the amount of HC is changed from 0.125 g/mil. to 0.075 g/mil. as in 1997 with correspondence to the LEV (Low Emission Vehicle), it is necessary to limit fuel leakage amount to be equal to 0.8 $mm^3$/min. or less per a single fuel injection valve. That is, since an oil-tight accuracy five times as strict as the conventional one is required, it becomes more important to improve the accuracy of shape of seat portion of the fuel injection valve.

As factors having influence on an oil-tightness of the fuel injection valve, it turns out that there are surface roughness R, circularity Rns, and the difference of seat angles $\Delta\theta$, which constitute the gap of a seat portion, between a needle valve 100 as a workpiece and a valve body 102 shown in FIGS. 9A and 9B. However, the difference of seat angles $\Delta\theta$ cannot be changed from a predetermined value in view of the performance of the fuel injection valve. Resulting from studies of necessary accuracies of the roughness R and the circularity Rns, as a factor which does not satisfy the necessary accuracy for satisfying the required value of LEV, i.e., the fuel leakage amount is equal to 0.8 $mm^3$/min. or less, according to the conventional pressing and contacting type grinding method, it turns out that there is a circularity on a contact surface of the needle valve. To satisfy the condition where the fuel leakage amount is equal to 0.8 $mm^3$/min. or less, the circularity on the contact surface of the needle valve needs to be 0.3 $\mu$m or less.

The conventional process for grinding a contact surface of the needle valve is composed of two processes including a rough-grinding process and a finish-grinding process performed after the rough-grinding process. To improve the circularity of the contact surface of the needle valve, there are conceived two methods. One method is to improve the circularity in the rough-grinding process, and the other is to increase a removed amount in the finish-grinding process according to the pressing and contacting type grinding method. However, it is difficult to employ the former method, because the cost increases to satisfy the condition where the circularity is equal to 0.3 $\mu$m or less in the rough-grinding process according to the conventional method. In the conventional grinding method, there is a dispersion of the circularity in the rough-grinding process, in a range of approximately 1.5 $\mu$m at the maximum. Accordingly, if the removed amount in the finish-grinding process according to the pressing and contacting type grinding method is equal to 1.5 $\mu$m or more, it satisfies the condition where the circularity of the contact surface of the needle valve in the finish-grinding process is equal 0.3 μm or less, which is the standard of the LEV.

FIG. 10 shows a conventional pressing and contacting type grinding method. A workpiece 100 is a needle valve, and a taper surface 101 is a contact surface of the needle valve. The workpiece 100 is pressed on a grindstone 104 by a constant force. By a rotation of the grindstone 104, the taper surface 101 of the workpiece 100 is ground. As shown in FIG. 11, the taper surface 101 is ground by the grindstone 104 such that abrasive grains 105 existing on a surface to be ground chip the taper surface 101. However, as shown in FIG. 12, a contact area (S) of the abrasive grain 105 with the taper surface 101 increases in accordance with an increase of a biting amount (t) of the abrasive grain having an obtuse cutting angle. As a result, as shown in FIG. 13, if the pressing force (F) is constant, a pressure (F/S) decreases in accordance with an increase of a biting amount (t) of the abrasive grain; and therefore, it becomes hard for the abrasive grain to bite the taper surface 101. That is, the abrasive grain passes on the same locus every lap; and therefore, after a predetermined time has elapsed, the abrasive grain 104 only rotates around the taper surface 101 without chipping the taper surface 101. To avoid this situation, a position of the abrasive grain 105 may be shifted from a groove 101*a* formed by the abrasive grain 105 so that the abrasive grain 105 can chip the taper surface 101 newly. However, in the grinding method for pressing the grindstone 104 on the workpiece 100, it is impossible to shift the abrasive grain 105 from the groove 101*a* to chip the taper surface 101 newly.

As a method for shifting the grinding locus of the abrasive grain while the grindstone 104 is pressed on the workpiece 100, the grindstone may be separated from the workpiece temporarily and be pressed on the workpiece again. However, to satisfy the condition where the removed amount is equal to 1.5 μm or less, twenty times of processes for pressing and contacting the grindstone on the workpiece are needed, and a time period of approximately 30 seconds therefor is required. This time period is much longer than that in the conventional method and cannot be employed as a grinding method for mass-production.

The above description is made with reference to the improvement of the circularity of the needle valve; however, the valve body contacting the needle valve has the same problem.

The grinding method and the grinding apparatus according to the present invention can be employed for any valves other than the above-mentioned needle valve and the valve body of the fuel injection valve to improve a circularity and a fluid-tightness thereof.

SUMMARY OF THE INVENTION

In view of the above-described problems, it is accordingly an object of the present invention to provide a method for grinding a taper surface and a grinding apparatus using the same, which are suitable for mass-production, to improve circularity of the taper surface.

According to an aspect of the present invention, in a method for grinding a taper surface inclined relative to an axial direction by using a grindstone, the grindstone is rotated relative to the taper surface while the grindstone is pressed on the taper surface by a predetermined pressing force in such a manner that an entire peripheral surface of the taper surface contacts the grindstone, and the taper surface is ground by the grindstone.

According to another aspect of the present invention, a grinding apparatus includes a pressing unit for generating a pressing force for pressing a taper surface on a grindstone in such a manner that an entire surface of the taper surface contacts the grindstone, and a rotating unit for rotating the grindstone relative to the taper surface while the grindstone is pressed on the taper surface by the pressing unit.

BRIEF DESCRIPTION OF THE DRAWINGS

Additional objects and advantages of the present invention will be more readily apparent from the following detailed description of preferred embodiments thereof when taken together with the accompanying drawings in which:

FIG. 4A shows a state where the workpiece and the grindstone are separated, FIG. 4B shows a state where the workpiece and the grindstone always contact each other;

DESCRIPTION OF THE PRESENTLY PREFERRED EMBODIMENTS

Embodiments of the present invention will be described with reference to the drawings.

Figure 1:
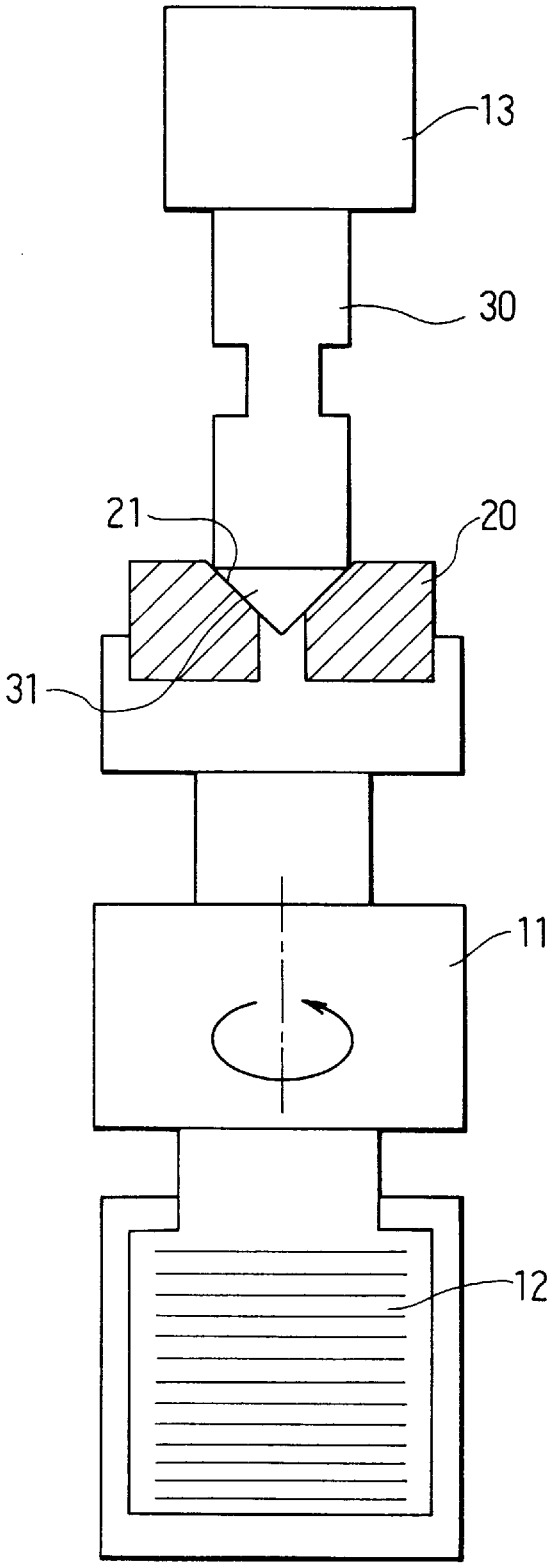
FIG. 1 is a view showing schematically a grinding apparatus for grinding a taper surface according to an embodiment of the present invention.

An embodiment in which a method for grinding a taper surface according to the present invention is employed for grinding a contact surface in a needle valve of a fuel injection valve is shown in FIG. 1.

A grindstone 20 is attached to a grindstone spindle 11 and rotates therewith. A PZT (piezoelectric element) is directly connected to a lower end of the grindstone spindle 11. By changing an electric power supplied to the PZT 12, a reciprocating vibration in an axial direction can be given to the grindstone 20 in addition to the rotating movement through the grindstone spindle 11.

A weight 13 is disposed on a workpiece to press down a taper surface 31 of the workpiece on a grindstone surface of the grindstone 20 by a predetermined force. In this embodiment, the workpiece is a needle valve to be ground, and a taper surface 31 is a contact surface on which the needle valve is seated.

Figure 2:
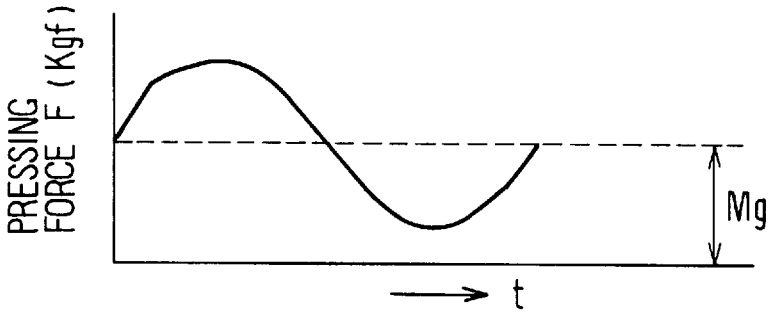
FIG. 2 is a graph showing characteristics of a variation of a pressing force of a grindstone on a workpiece.

Here, if the mass of the weight 13 is M, gravitational acceleration is g, and the amplitude and frequency of vibration of the PZT 12, which are applied to the grindstone 20 through the grindstone spindle 11, are a and f, respectively, a pressing force (F) for pressing the workpiece 30 on the grindstone 20 is given as a sine wave with Mg as a center, as shown in FIG. 2. The sine wave is expressed as the following equation (1).

$$F=Mg+Ma(2\pi F)^2\ \mathrm{Sin}(2\pi ft) \quad (1)$$

Figure 3:
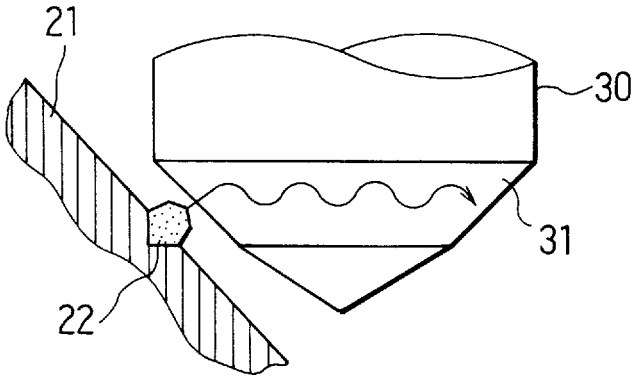
FIG. 3 is a schematic explanation view showing a grinding locus of an abrasive grain on a contact surface.

A result of an experiment in a grinding locus of a specified one of the abrasive grains while the grindstone contacts the workpiece 30 by the sine wave pressing force (F) as shown in FIG. 2 is shown in FIG. 3. It is ensured that the grinding locus of the taper surface 31 by the one abrasive grain 22 forms a sine wave in the same manner as the pressing force (F). A phase of the sine wave in the equation (1) is adjusted every lap such that the grinding loci do not overlap with one another.

A reason why the removed amount can be increased by giving the pressing force (F) as expressed in the equation (1) will be described.

Figure 14:
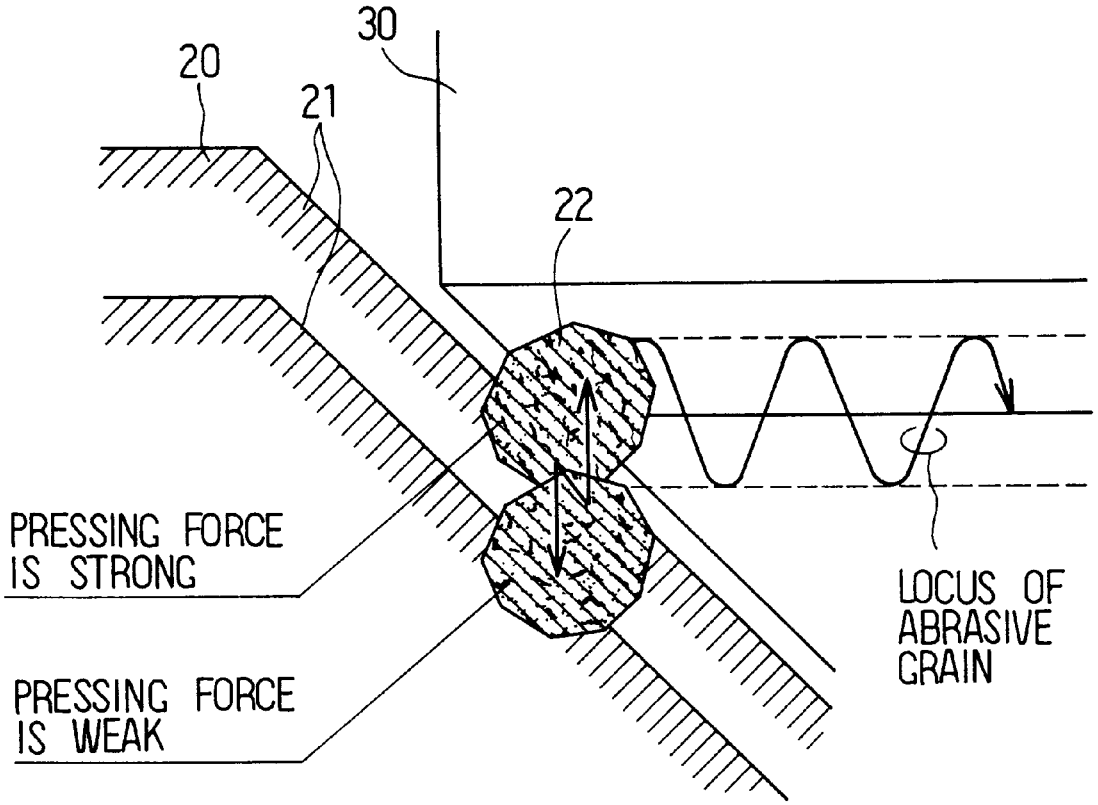
FIG. 14 is a schematic explanation view showing states where an abrasive grain bites a workpiece according to a strength of a pressing force.

As shown in FIG. 14, when the pressing force is strong, the abrasive grain 22 bites deeply in the workpiece 30. On the hand, when the pressing force (F) is weak, the abrasive grain 22 bites slightly in the workpiece 30. In this way, a contact area between the workpiece 30 and the abrasive grain 22 varies in accordance with the pressing force (F). Therefore, the biting amount of the abrasive grain 22 varies. Accordingly, the biting pressure (F/S) per a single abrasive grain 22 moves on the line so that the biting pressure (F/S) can be avoided to be lower than a harder line where it is impossible for the abrasive grain to bite the workpiece.

Therefore, the abrasive grain 22 can certainly bite the workpiece so that the grinding process can be performed.

Further, by maintaining the biting pressure (F/S) always at a value being higher than the region where it is impossible for the abrasive grain to bite the workpiece, the grinding process can be continuously performed while the abrasive grain always bites the workpiece, thereby improving a grinding efficiency.

Figure 4A:
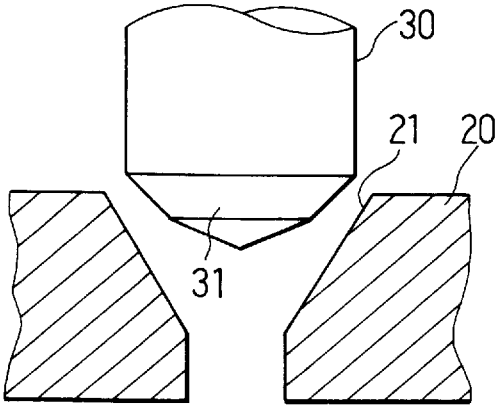
FIGS. 4A and 4B are schematic explanation views showing grinding states of a workpiece and a grindstone.
Figure 4B:
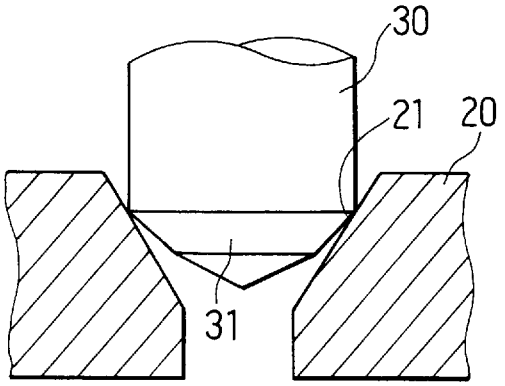

Next, the most suitable condition of vibration applied to the grindstone 20 by the PZT 12 according to the embodiment will be examined. In this embodiment, since the workpiece 30 to be ground is pressed on the grindstone 20 by the gravitational acceleration, when the grindstone 20 vibrates vertically, there occurs a state where a grindstone surface 21 is separated from the taper surface 31. Therefore, according to a relationship between the maximum acceleration $(a\times(2\pi f)^2)$ and the gravitational acceleration (g) adding to the workpiece 30, there exist two states as shown in FIGS. 4A and 4B. The state in FIG. 4A shows a case where the downward maximum acceleration $(a\times(2\pi f)^2)$ is greater than the gravitational acceleration (g), and the state in FIG. 4B shows a case where the downward maximum acceleration $(a\times(2\pi f)^2)$ is lower than the gravitational acceleration (g). As shown in FIG. 4A, in the case where the maximum acceleration $(a\times(2\pi f)^2)$ is greater than the gravitational acceleration (g), the grindstone surface 21 and the taper surface 31 may be separated from each other. In each of cases shown in FIGS. 4A and 4B, since the grindstone 20 vibrates in an axial direction, the grinding locus of the abrasive grain 22 can be shifted.

Figure 5:
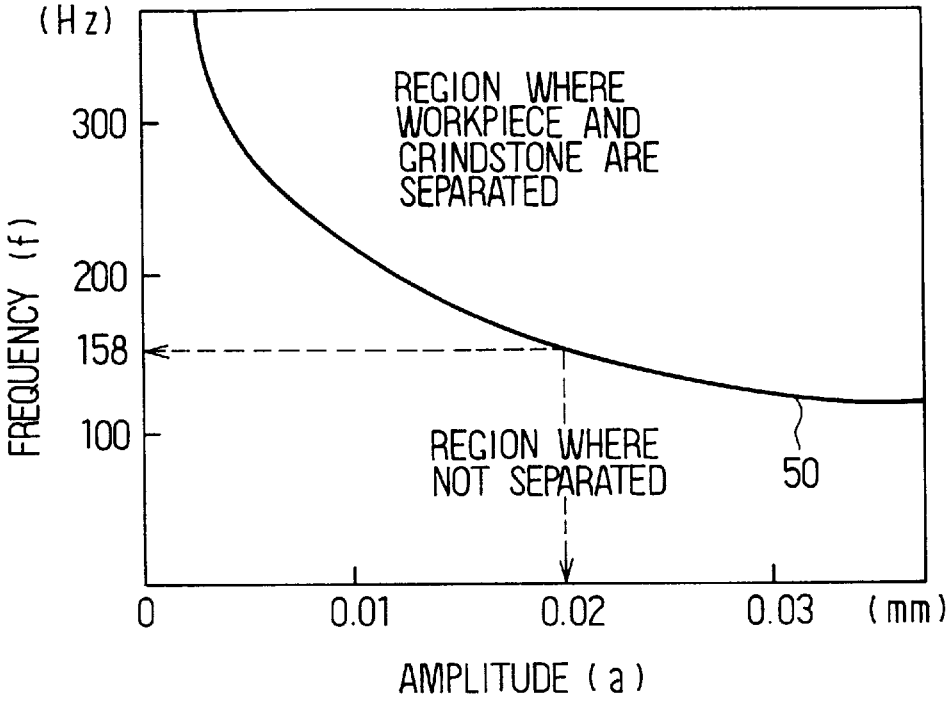
FIG. 5 is a graph showing a relationship between an amplitude and a frequency.

Next, the most suitable vibration condition, under which a case of $(a\times(2\pi f)^2=g)$ is a standard, will be obtained by a grinding test. A curve 50 shown in FIG. 5 satisfies a condition of $(a\times(2\pi f)^2=g)$. When the amplitude (a) is set for 0.02 mm, for instance, the frequency (f) becomes 158 Hz. Therefore, in the grinding test with the frequency (f) of 158 Hz as a harder, three levels of 90, 120 and 150 Hz in a direction where the workpiece 30 and the grindstone 20 are not separated and two levels of 170 and 200 Hz in a direction where the workpiece 30 and the grindstone 20 are separated are evaluated.

Figure 6:
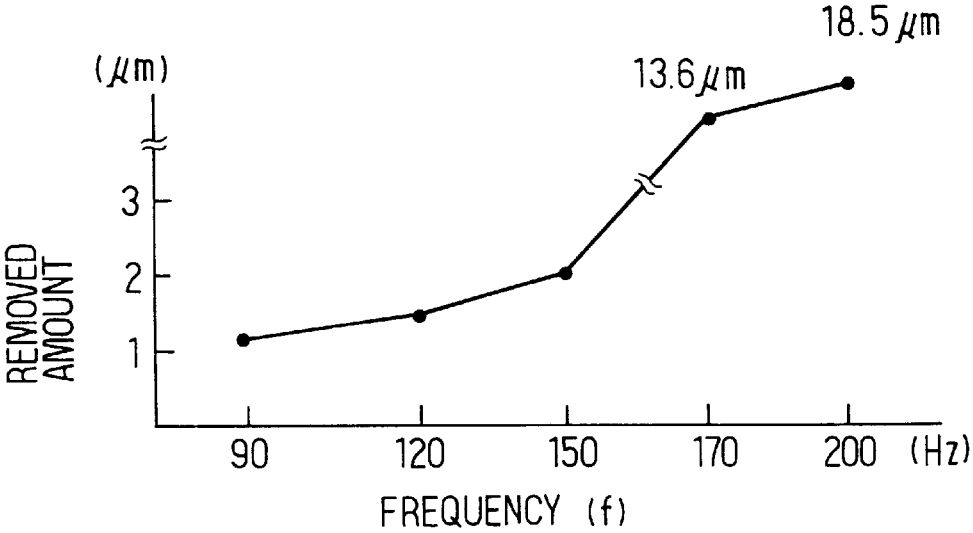
FIG. 6 is a graph showing a relationship between a frequency and a removed amount.

A relationship between a frequency and a removed amount is shown in FIG. 6. As being understood therefrom, the removed amount increases in accordance with the increase of the frequency. As expressed in the equation (1), a square of the frequency (f) works for the pressing force (F). Therefore, it is thought that the pressing force (F) increases in accordance with the increase of the frequency (f) so that the removed amount increases. It is also understood that the removed amount suddenly changes from a harder of the frequency 158 Hz. It is thought that, when the frequency (f) exceeds 158 Hz, there occurs a state where the workpiece 30 and the grindstone 20 are separated, and an impact force where the workpiece 30 contacts the grindstone 20 again adds to the pressing force (F).

Figure 7:
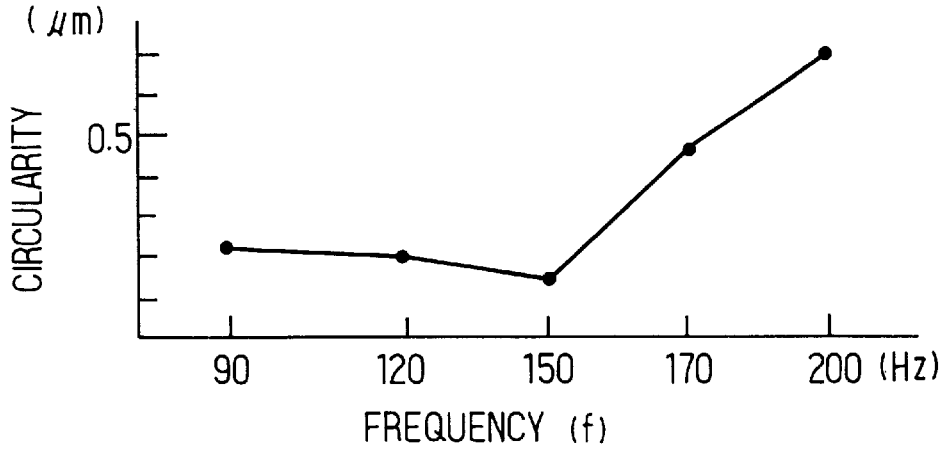
FIG. 7 is a graph showing a relationship between a frequency and a circularity.

Next, a relationship between a frequency (f) and circularity is shown in FIG. 7. The circularity improves in accordance with the increase of the frequency (f); however, the circularity deteriorates suddenly when the frequency (f) exceeds 158 Hz. Because a phenomenon in which the workpiece 30 and the grindstone 20 are separated and subsequently contact again occurs every short time period of 6 ms or less, the workpiece 30 may be separated from the grindstone 20 before an entire surface of the taper surface 31 is seated on the grindstone surface 21 of the grindstone 20. Therefore, it is presumed that a mechanism for creating circularity in the pressing and contacting type grinding method for removing convex portions on the surface to be ground while binding an entire peripheral surface of the workpiece is disturbed. According to the above-described result, it turns out that the most suitable condition is immediately before the changing point where the workpiece 30 and the grindstone 20 are separated. That is, under the most suitable condition, the amplitude (a) is set for 0.02 mm, and the frequency (f) is set for 150 Hz which is immediately before the changing point of 158 Hz.

Figure 8:
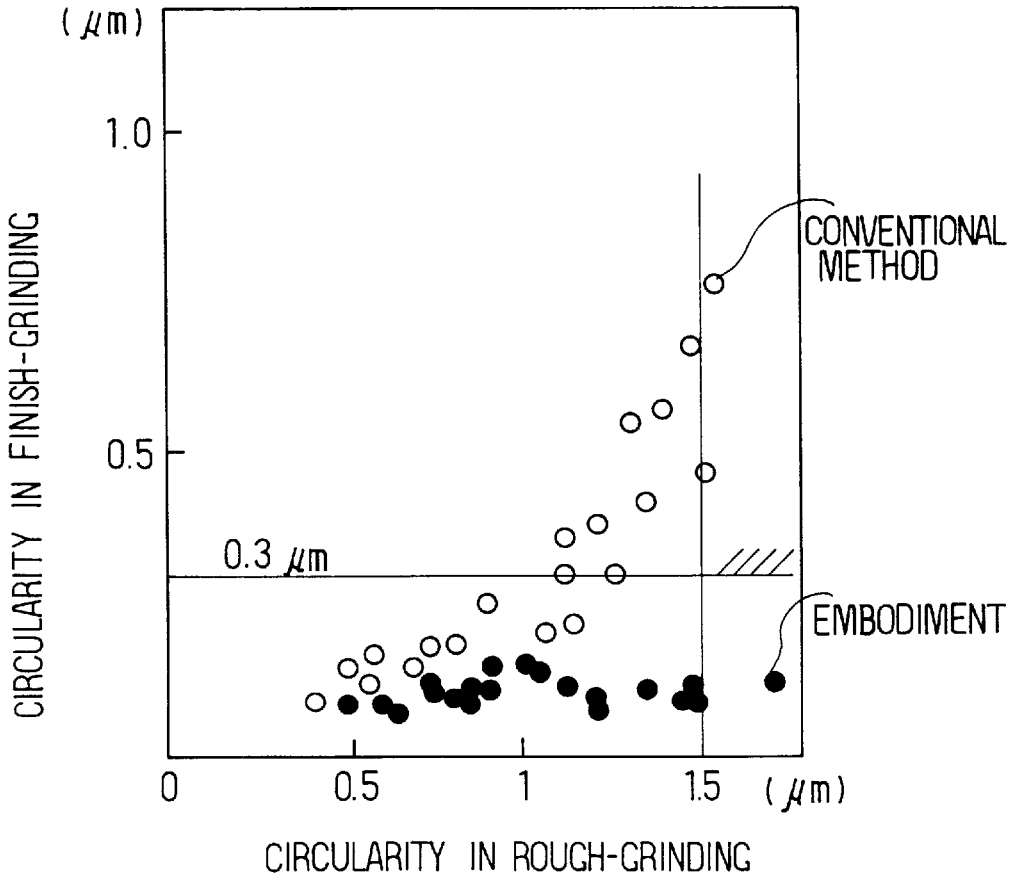
FIG. 8 is a distribution map showing a relationship between a circularity in a rough-grinding process and a circularity in a finish-grinding process.
Figure 9A:
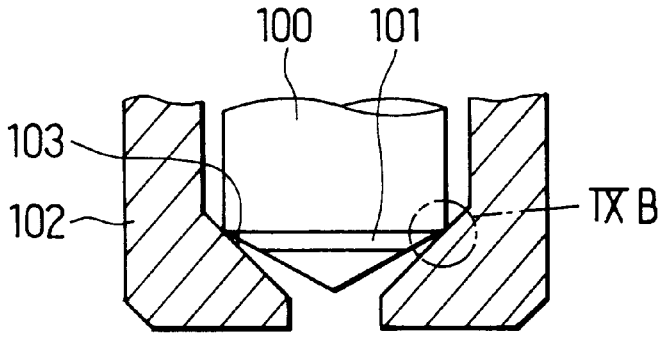
FIG. 9A PRIOR ART
FIG. 9A is a schematic explanation view showing a state where the needle valve and the valve body contact each other.
Figure 9B:
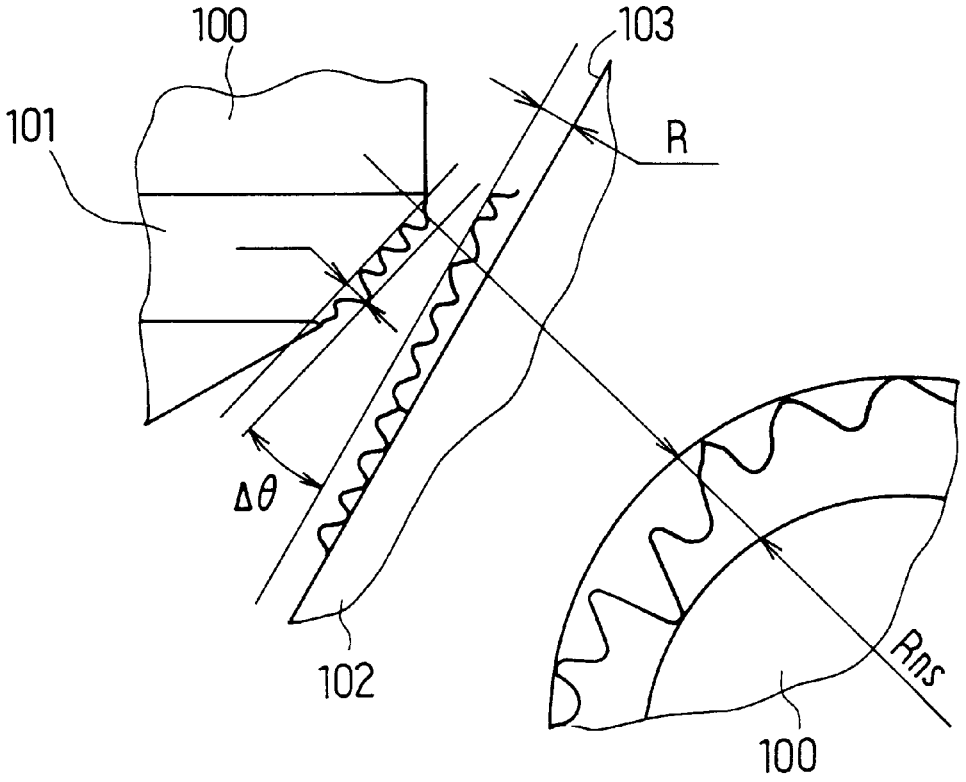
FIG. 9B PRIOR ART
FIG. 9B is an enlarged view of IXB in FIG. 9A.
Figure 10:
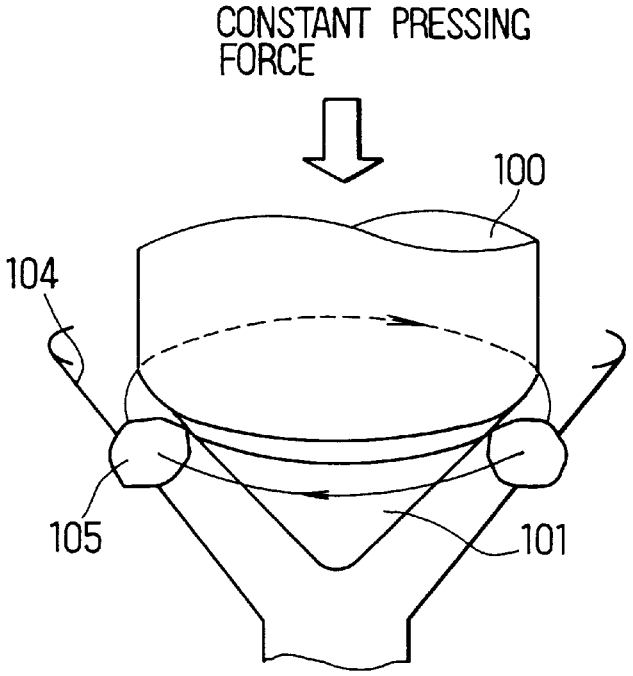
FIG. 10 PRIOR ART
FIG. 10 is a schematic explanation view showing a grinding state of a workpiece and a grindstone in a conventional method.
Figure 11:
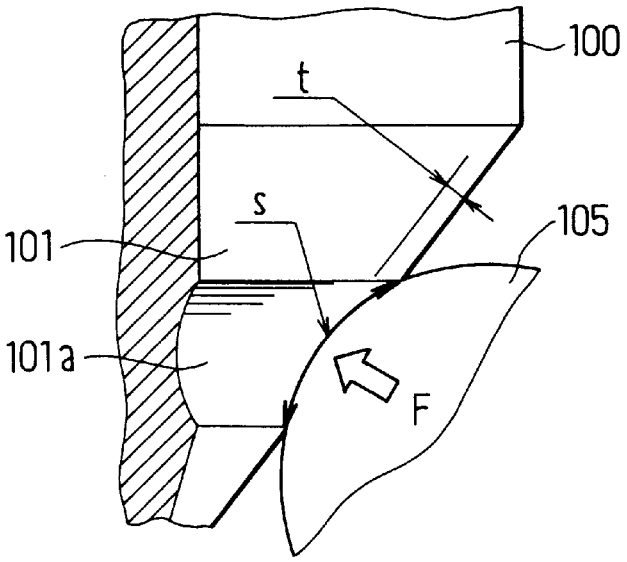
FIG. 11 PRIOR ART
FIG. 11 is a detailed explanation view showing a grinding state of the workpiece and the grindstone in a conventional method.
Figure 12:
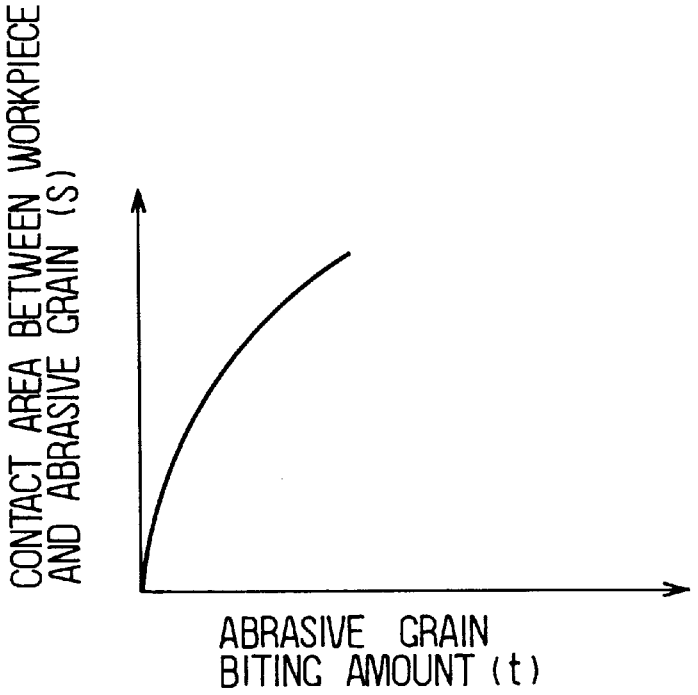
FIG. 12 PRIOR ART
FIG. 12 is a graph showing a relationship between a biting amount of an abrasive grain and a contact area of the abrasive grain with a workpiece in the conventional method.
Figure 13:
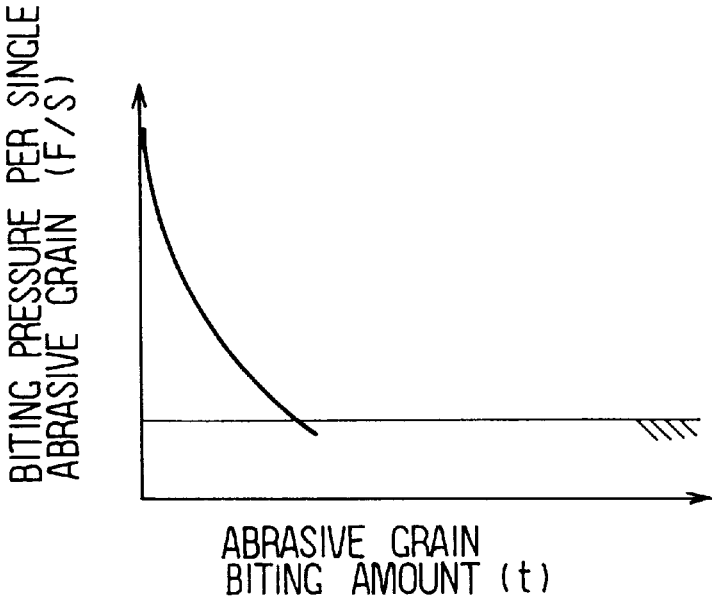
FIG. 13 is a graph showing a relationship between the biting amount of the abrasive grain and the biting pressure per a single abrasive grain.

A result of the grinding process under the above-described most suitable condition is shown in FIG. 8. Measurements are performed under a condition that the amplitude (a) is set for 0.02 mm, the frequency (f) is set for 150 Hz, the grinding time period is set for 3 sec., and the mass of the weight (M) is set for 0.8 Kg.

According to the result, the removed amount can be greater than 1.5 $\mu$m. As a result, as shown in FIG. 8, according to the embodiment, the workpiece 30 having the circularity of approximately 1.5 $\mu$m after the rough-grinding process can have the circularity of 0.3 $\mu$m or less after the finish-grinding process according to the pressing and contacting type method. Accordingly, the fuel leakage amount can be equal to 0.8 $mm^3$/min. or less to satisfy the standard of the fuel leakage amount for the LEV.

According to the above-described embodiment, by employing the PZT 12 for applying a vibration having a predetermined frequency to the grindstone 20 in the conventional pressing and contacting type grinding apparatus, with a low-cost equipment investment, the circularity of the needle valve can be improved, and the amount of fuel leaking from the fuel injection valve can be reduced.

Further, in the above-described embodiment, the frequency (f) employed in the grinding apparatus for implementing the grinding method is set for 150 Hz as the most suitable value; however, by selecting the amplitude (a) appropriately and suppressing the frequency to be less than approximately 500 Hz, it is possible to reduce abrasion of a sliding portion in a rotation driving portion, for example, thereby improving durability of the apparatus.

Still further, in the above-described embodiment, vibration having a predetermined frequency is applied to the grindstone 20; however, the vibration having a predetermined frequency may be applied to the workpiece 30.

Still further, in the above-described embodiment, the method for grinding a taper surface and the grinding apparatus according to the present invention are employed for grinding a convex contact surface of the needle valve; however, the method according to the present invention may be employed for grinding the concave seat surface of the valve body of the fuel injection valve. The method for grinding a taper surface and the grinding apparatus according to the present invention are employed not only for the needle valve and the valve body of the fuel injection valve but also for any taper surfaces to improve the circularity thereof.

Still further, in the above-described embodiment, the PZT 12 is employed as means for changing the strength of the force for pressing the grindstone on the taper surface according to the time passage by the predetermined frequency; however, any kind of means for providing vibration, such as a super magnetostrictive element, a motor, a linear motor, an electromagnetic solenoid, a speaker and mechanical means including a cam, a hydraulic mechanism, or an air cylinder may be employed.

In the above-described embodiment, the gravitational force (Mg) is contained in the force (F) for pressing workpiece on the grindstone 20; however, by using a force (F') with an additional pressing means, the force (F) may be expressed as the following equation (2).

$$F=F'+Mg+Ma(2\pi f)^2\ \mathrm{Sin}(2\pi ft) \qquad (2)$$

As the additional pressing means for applying the force (F'), a spring, hydraulic pressure, or an air cylinder may be employed. The positional relationship between the workpiece and the grindstone is not limited to the vertical direction, but may be the horizontal direction or an intermediate direction which form a constant angle with the vertical direction. Further, when the gravitational force (Mg) is employed as the force (F'), the positional relationship between the workpiece and the grindstone in the vertical direction is not limited to the embodiment in FIG. 1. For example, the workpiece may be disposed at a lower side, and the grindstone may be disposed at an upper side. According to this positional relationship, the same effect can be obtained.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A method for grinding a taper surface inclined relative to an axial direction of a workpiece by using a co-axially aligned rotating tapered grindstone, said method comprising the steps of:

pressing said grindstone on said taper surface by a controllable pressing force in such a manner that an entire peripheral surface of said taper surface contacts said grindstone and so that the rotational axis of said grindstone and the axis of said taper surface remain in constant alignment;

rotating said grindstone relative to an entire peripheral surface of said taper surface while pressing an entire peripheral surface of said grindstone on said entire peripheral surface of said taper surface;

grinding said taper surface by said grindstone; and varying said pressing force during said step of grinding to control finished taper surface parameters including circularity of the tapered surface.

2. A method as in claim 1, wherein said taper surface is formed as a convex surface.

3. A method as in claim 1, wherein said taper surface is formed as a concave surface.

4. A method as in claim 1, wherein said pressing force is changed at a predetermined frequency, said predetermined frequency being set in a range where an abrasive grain of said grindstone which faces the taper surface always contacts said taper surface.

5. A method as in claim 4, wherein an amplitude of said vibration "a", said predetermined frequency "f", and a gravitational acceleration "g" satisfy the following relation:

$$ax(2\pi f)^2<g.$$

6. A method as in claim 5, wherein said predetermined frequency "f" is less than 500 Hz.

7. A method as in claim 1, wherein said taper surface is on a needle valve of a fuel injection valve.

8. The method of claim 1, wherein the step of varying comprises varying said pressing force to move abrasive grains along a selectively variable locus on said taper surface to control said taper surface parameters.

9. A grinding apparatus for grinding a taper surface inclined relative to an axial direction of a workpiece, said apparatus comprising:

rotatable tapered grindstone for grinding said taper surface;

a pressing unit for generating a pressing force for pressing said taper surface on said grindstone in such a manner that an entire surface of said taper surface contacts said grindstone and so that the rotational axis of said grindstone and the axis of said taper surface remain in constant alignment;

a changing unit for changing said pressing force while said taper surface is ground by said rotating grindstone while maintaining an entire peripheral surface of said taper surface pressed onto an entire peripheral surface of said grindstone; and a rotating unit for rotating said grindstone relative to said taper surface while said taper surface is pressed on said grindstone by said pressing unit whereby circularity of the tapered surface is enhanced.

10. A grinding apparatus as in claim 9, wherein said changing unit includes a vibration unit for applying a vibration to said grindstone in an axial direction, said vibration unit including a piezoelectric element.

11. A grinding apparatus as in claim 9, wherein said changing unit changes said pressing force at a predetermined frequency, said predetermined frequency being set in a range where an abrasive grain of said grindstone which faces the taper surface always contacts said taper surface.

12. A grinding apparatus as in claim 11, wherein an amplitude of said vibration "a", said predetermined frequency "f", and a gravitational acceleration "g" satisfy the following relation:

$$ax(2\pi f)^2<g.$$

13. A grinding apparatus as in claim 12, wherein said predetermined frequency "f" is less than 500 Hz.

14. The apparatus of claim 9, wherein said changing unit varies said pressing force to move abrasive grains in contact with said taper surface in a selectively variable pattern.

15. A method for grinding a taper surface inclined relative to an axial direction of a workpiece by using a rotating tapered grindstone, said method comprising:

pressing said grindstone on said taper surface by a predetermined axial pressing force in an oscillating manner at a sub-ultrasonic frequency such that an abrasive grain of said grindstone which faces the taper surface always contacts said taper surface;

rotating said grindstone relative to said taper surface while pressing said grindstone on said taper surface;

grinding said taper surface by said grindstone; and changing the strength of said pressing force while said taper surface is ground by said grindstone whereby circularity of the tapered surface is enhanced.

16. The method of claim 15, further comprising the step of moving abrasive grains in contact with said taper surface along a selectively variable locus as a result of said step of changing.

17. The method of claim 15, wherein the axial pressing force frequency is 500 Hz or less.

18. The method of claim 17, wherein the axial pressing force frequency is 158 Hz or less.

19. A grinding apparatus for grinding a taper surface inclined relative to an axial direction of a workpiece, said apparatus comprising:

a rotatable grindstone for grinding said taper surface;

a pressing unit for generating an axial pressing force at a characteristic sub-ultrasonic frequency that enables grinding surface abrasive grains to constantly contact said taper surface along a resulting grinding locus for pressing said taper surface on said grindstone in such a manner that an abrasive grain of said grindstone which faces the taper surface always contacts said taper surface;

a changing unit for changing said pressing force while said taper surface is ground by said grindstone; and a rotating unit for rotating said grindstone relative to said taper surface while said taper surface is pressed on said grindstone by said pressing unit whereby circularity of the tapered surface is enhanced.

20. The apparatus of claim 19, wherein said changing unit changes said pressing force to move abrasive grains in contact with said taper surface along a selectively variable locus.

21. The apparatus of claim 19, wherein the axial pressing force oscillates at a frequency of 500 Hz or less.

22. The apparatus of claim 21, wherein the axial pressing force oscillates at a frequency of 158 Hz or less.

23. A method for grinding a tapered surface onto a workpiece at an incline with respect to an axial direction, said method comprising the steps of:

pressing an entire peripheral surface of said workpiece directly against an entire peripheral surface of a tapered surface grindstone, which rotates about said axial direction, with a force that maintains continuous contact between said entire peripheral surface of the workpiece and said entire peripheral surface of a tapered surface grindstone during an entire grinding process and so that the rotational axis of said grindstone and the axis of said taper surface remain in constant alignment; and axially varying the force used to press said workpiece against the grindstone, said force being varied within a range of limited amplitude and at a frequency of 500 Hz or less so as to maintain continuous contact between the workpiece and said grindstone during the entire grinding process whereby circularity of the tapered surface is enhanced.

24. The method of claim 23, wherein said step of varying comprises varying said force to move abrasive grains along said taper surface in a predetermined pattern.

* * * * *